US006193080B1

(12) United States Patent
Castillo

(10) Patent No.: US 6,193,080 B1
(45) Date of Patent: Feb. 27, 2001

(54) PAINT BRUSH SUPPORT

(76) Inventor: David Castillo, 4827 Betty Lou St., San Antonio, TX (US) 78229

( * ) Notice: Subject to any disclaimer, the term of this patent is extended or adjusted under 35 U.S.C. 154(b) by 0 days.

(21) Appl. No.: 09/442,448

(22) Filed: Nov. 18, 1999

(51) Int. Cl.[7] ..... A47B 81/07
(52) U.S. Cl. ..... 211/66
(58) Field of Search ..... 211/66, 65, 106, 211/133.5, 181.1, 85.9, 85.31, 119; 248/110; 118/500

(56) References Cited

U.S. PATENT DOCUMENTS 4,633,773 * 1/1987 Jay .
4,768,658 * 9/1988 Shafto .
4,944,415 * 7/1990 Orbach ..... 211/181.1
5,390,888 * 2/1995 Rogers ..... 248/110
5,829,603 * 11/1998 Martineau ..... 211/66

* cited by examiner

*Primary Examiner*—Alvin Chin-Shue
*Assistant Examiner*—Sarah Purol
(74) *Attorney, Agent, or Firm*—Stephen R. Greiner

(57) ABSTRACT

A support for suspending a plurality of paint brushes in a solvent filled bucket. The support includes a pair of inverted, U-shaped members attached at their midpoints in a crossing relationship. Suspended from the top of each of the members is one or more hooks for holding a paint brush by its handle above the bottom of the bucket. Special carriers may also be suspended from the hooks for holding paint rollers in the bucket as well.

9 Claims, 1 Drawing Sheet

PAINT BRUSH SUPPORT

FIELD OF THE INVENTION

The present invention relates generally to supports for brushes or brooms.

BACKGROUND OF THE INVENTION

Many painters, professional and non-professional alike, reduce the lives of their paint brushes and rollers by improper handling. It is common, for example, for painters to drop their brushes and rollers in a bucket filled with solvent so that paint may be dissolved from brush bristles and roller naps. Unfortunately, the bristles and naps, bearing the weight of the associated brushes and rollers, tend to become permanently set in a bent or flattened condition making such difficult to use at a later time. Also, brushes and rollers tend to become fully submerged in solvent thus requiring a painter to plunge his hands into solvent for brush or roller retrieval.

To overcome these problems, devices for supporting paint brushes in containers have been proposed. Many of these devices have parts from which brushes are suspended by their handles so that only their bristles are held submerged in solvent. Most of these devices, however, are complex in their construction making such difficult to use and costly to acquire. Consequently, commercial acceptance of such devices has, heretofore, been limited.

SUMMARY OF THE INVENTION

In light of the problems associated with the known devices for supporting paint brushes in containers, it is a principal object of the invention to provide a device, adapted to support a plurality of paint brushes of in a solvent-carrying bucket, which is lightweight in construction, inexpensive to manufacture, and dependable in use.

It is another object of the invention to provide a paint brush support of the type described which may be employed to suspend one or more paint rollers in a solvent-filled bucket without damage to the naps of the rollers.

Briefly, the support in accordance with this invention achieves the intended objects by featuring a frame having a pair of inverted, U-shaped members formed of stiff wire. The U-shaped members are joined at their upper ends in a crossed relationship. A plurality of hooks secured to the upper ends of the U-shaped members for hanging paint brushes and rollers.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 2:
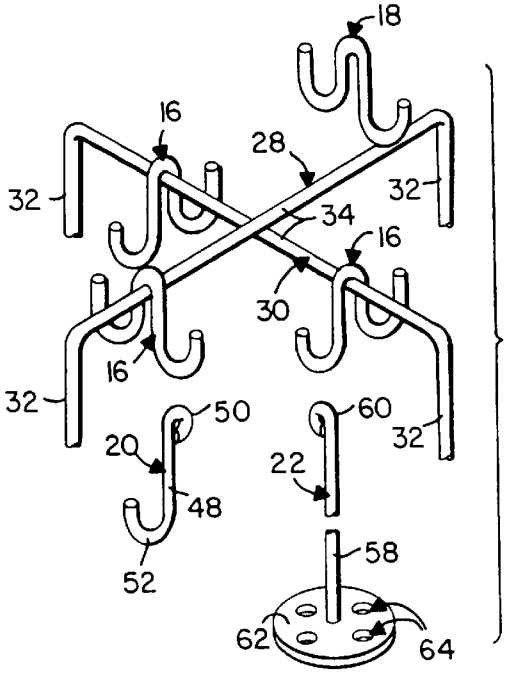
FIG. 2 is an exploded perspective view of the upper portion of the paint brush support of FIG. 1 showing details thereof.
Figure 3:
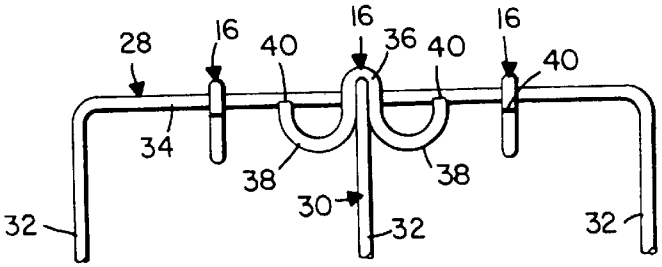
FIG. 3 is a side view of the upper portion of the paint brush support.
Figure 1:
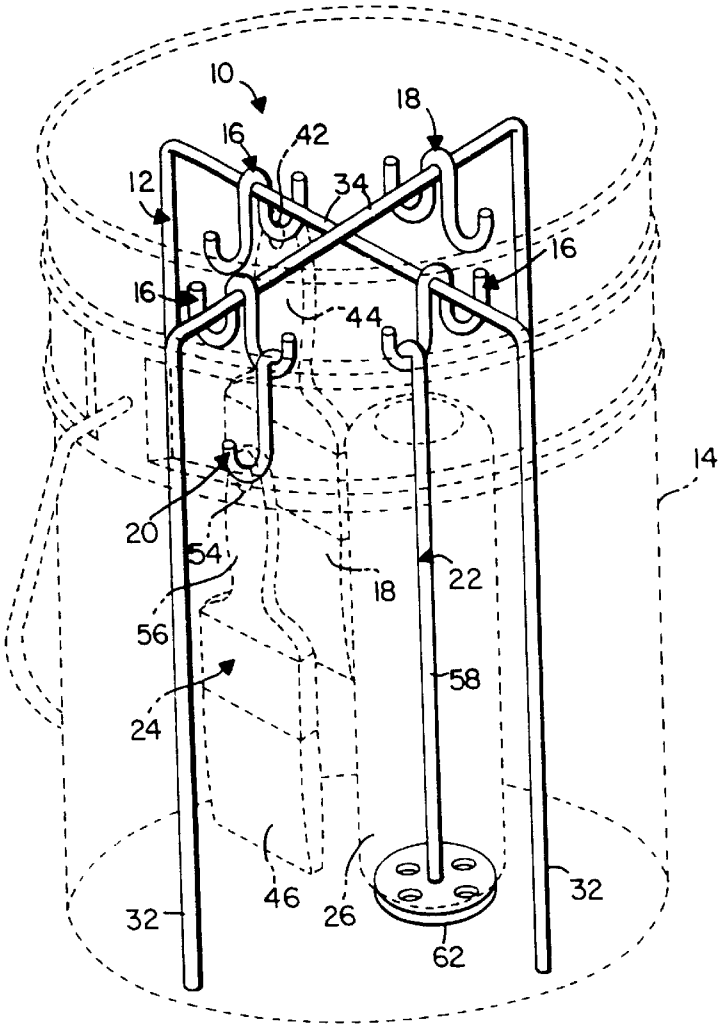
FIG. 1 is a perspective view of a paint brush support in accordance with the present invention shown in a bucket and carrying a paint roller and a pair of paint brushes.

Referring now to the FIGS., a paint brush support in accordance with the present invention is shown at 10. Support 10 includes a rigid frame 12 adapted for snug positioning within a bucket 14 filled partially with solvent (not shown). Hooks 16 and 18 are carried at the top of frame 12 for suspending one or more paint brushes 18 within bucket 14. Carriers 20 and 22 may also be suspended from hooks 16 or 18 for retaining a small paint brush 24 and a paint roller 26 in bucket 14.

Frame 12 includes a pair of inverted, U-shaped members 28 and 30 formed of stiff wire. Members 28 and 30 each have a pair of legs 32 joined at their upper ends by an integral cross piece 34. Preferably, cross pieces 34 are oriented at ninety degrees to one another and are joined together at their midpoints as by welding.

Hooks 16 and 18 are formed from short pieces of wire and secured to cross pieces 34 between the point of their intersection and legs 32. Each hook 16 and 18 has an inverted U-shaped shank portion 36 adapted to receive a cross piece 34 therein. Integrally fastened to the opposite sides of each shank portion 34 are a pair of U-shaped hook portions 38. Each of the hook portions 38 terminates in a free end 40 which may be inserted through an aperture 42 at the upper end of paint brush handle 44.

Hooks 16 are affixed by welding to cross pieces 34 whereas hook 18 is removable. Such a construction permits brushes and rollers of large size or large number to be accommodated by support 10 without binding against one another. Of course, if desired, hook 18 can be welded to cross piece 34 and all, none, or some intermediate number of hooks 16 can be made removable like hook 18.

Brush carrier 20 is provided for submerging the bristles 46 of a relatively short paint brush 24 in a small amount of solvent in bucket 14. Carrier 20 is formed of stiff wire and includes a shank 48 with a loop 50 at its upper end and a catch 52 at its lower end. As shown, loop 50 is sized for the easy passage of the free end 40 of a hook 16 or 18 and catch 52 is sized to be run into the aperture 54 in the upper end of paint brush handle 56.

Roller carrier 22 is provided for retaining a paint roller 26 in an upright position within bucket 14. Preferably, carrier 22 includes a metallic rod 58 having a loop 60 formed at its upper end and a metallic disk 62 secured as by welding to its lower end. Loop 60 is sized for releasable positioning on a hook 16 or 18. Disk 62, on the other hand, is sized to support the lower end of roller 26 and is provided with a plurality of bores 64 for enhanced solvent circulation and drainage.

Use of support 10 is straightforward. First, a painter slides support 10 into bucket 14 with legs 32 snugly positioned against the inner wall of bucket 14 to prevent upset of support 10. Next, brush 18 is hung on one of the hooks 16 and brush 24 is hung on carrier 20. With roller 26 positioned over rod 58, carrier 22 is suspended from one of the hooks 16. Finally, bucket 14 is filled with a solvent to a depth sufficient to cover only brush bristles or the nap of a roller.

The painter may remove the brushes 18 and 24 and roller 26 from bucket 14 at any time to wipe paint residue therefrom and complete the brush cleaning process. If desired, frame 12 may be removed from bucket 14, if desired, so that brushes and rollers can drip dried. Since the support 10 prevents brush bristles and roller naps from touching the bottom of bucket 14 or any other planar supporting surface, bristles and naps cannot be damaged. The useful lives of paint brushes and paint rollers are, thus, prolonged by use of support 10.

While the invention has been described with a high degree of particularity, it will be appreciated by those skilled in the art that modifications may be made thereto. For example, the number and location of hooks 16 and 18 may be varied to suit the needs of a particular painter. Therefore, it is to be understood that the present invention is not limited to the sole embodiment described above, but encompasses any and all embodiments within the scope of the following claims.

I claim:

1. A paint brush support, comprising:

a frame having a pair of inverted, U-shaped members formed of stiff wire being joined at their tops in a crossed relationship; and, a plurality of hooks secured to the tops of said inverted, U-shaped members.

2. The paint brush support according to claim 1 further comprising a brush carrier formed of stiff wire and being releasably secured to one of said hooks, said brush carrier comprising:

a shank having an upper end and a lower end;

a loop formed at the upper end of said shank sized for positioning on one of said hooks; and, a U-shaped catch formed at the lower end of said shank.

3. The paint brush support according to claim 1 further comprising a roller carrier releasably secured to one of said hooks, said roller carrier comprising:

a rod having an upper end and a lower end;

a loop formed in the upper end of said rod sized for positioning on one of said hooks; and, a disk secured to the lower end of said rod.

4. The paint brush support according to claim 3 wherein said disk is provided with a plurality of bores for the passage of liquids.

5. A paint brush support, comprising:

a pair of inverted, U-shaped members each having a pair of legs joined by a cross piece, said cross pieces being affixed to one another at right angles; and, a plurality of hooks secured to the tops of said inverted, U-shaped members, each of said hooks including:

an inverted, U-shaped shank portion having opposed sides and being adapted to receive a cross piece therein; and, a pair of U-shaped hook portions integrally fastened to the opposite sides of each shank portion.

6. The paint brush support according to claim 5 further comprising a brush carrier formed of stiff wire and being releasably secured to one of said hooks, said brush carrier comprising:

a shank having an upper end and a lower end;

a loop formed at the upper end of said shank sized for positioning on one of said hooks; and, a U-shaped catch formed at the lower end of said shank.

7. The paint brush support according to claim 5 further comprising a roller carrier releasably secured to one of said hooks, said roller carrier comprising:

a rod having an upper end and a lower end;

a loop formed in the upper end of said rod sized for positioning on one of said hooks; and, a disk secured to the lower end of said rod.

8. The paint brush support according to claim 7 wherein said disk is provided with a plurality of bores for the passage of liquids.

9. A paint brush support, comprising:

a pair of inverted, U-shaped members each having a pair of legs joined by a cross piece, said cross pieces being affixed to one another at right angles; and, a plurality of hooks secured to the tops of said inverted, U-shaped members, each of said hooks including:

an inverted, U-shaped shank portion having opposed sides and being adapted to receive a cross piece therein; and, a pair of U-shaped hook portions integrally fastened to the opposite sides of each shank portion; and, each of said inverted, U-shaped members and said plurality of hooks being respectively formed from a single piece of stiff wire.

* * * * *